United States Patent [19]

Gracia

[11] 4,109,476

[45] Aug. 29, 1978

[54] DOCKING AN OFFSHORE STRUCTURE WITH A SUBMERGED FIXTURE

[75] Inventor: Bert E. Gracia, Houston, Tex.

[73] Assignee: Brown & Root, Inc., Houston, Tex.

[21] Appl. No.: 798,880

[22] Filed: May 20, 1977

[51] Int. Cl.[2] ..... E02B 17/00

[52] U.S. Cl. ..... 61/87; 61/86

[58] Field of Search ..... 61/87, 88, 91, 92, 90, 61/86, 97, 100, 101; 166/89, 0.5, 0.6; 175/7, 8, 9

[56] References Cited

U.S. PATENT DOCUMENTS

| | | | |
|---|---|---|---|
| 2,905,414 | 9/1959 | Zierden | 248/527 X |
| 3,186,180 | 6/1965 | Swanlund et al. | 61/87 |
| 3,329,380 | 7/1967 | Graves et al. | 47/40.5 |
| 3,500,906 | 3/1970 | Petersen | 166/0.6 |
| 3,517,738 | 6/1970 | Petersen | 166/0.6 |
| 3,528,254 | 9/1970 | Graham | 61/88 |
| 3,572,044 | 3/1971 | Pogonowski | 166/0.5 X |
| 3,688,840 | 9/1972 | Curington et al. | 166/0.6 |
| 3,705,623 | 12/1972 | Van Eek et al. | 166/0.6 |
| 3,714,788 | 2/1973 | Mott | 61/89 |
| 3,795,114 | 3/1974 | De Cremiers et al. | 166/0.6 X |
| 3,913,669 | 10/1975 | Brun et al. | 166/0.6 |

*Primary Examiner*—Dennis L. Taylor

*Attorney, Agent, or Firm*—Kenway & Jenney

[57] ABSTRACT

An offshore oil or gas recovery station is established by docking a jacket with a submerged wellhead and supporting a platform on the jacket above the water surface. The jacket is lowered upon the wellhead so that a guide collar on the jacket passes downwardly around the wellhead. Alignment pins on the guide collar are fully advanced by a diver so as to contact the wellhead and effect alignment between the wellhead and a conduit which is carried on the jacket by a temporary connection. The conduit is released and is lowered onto the wellhead for connection therewith.

17 Claims, 9 Drawing Figures

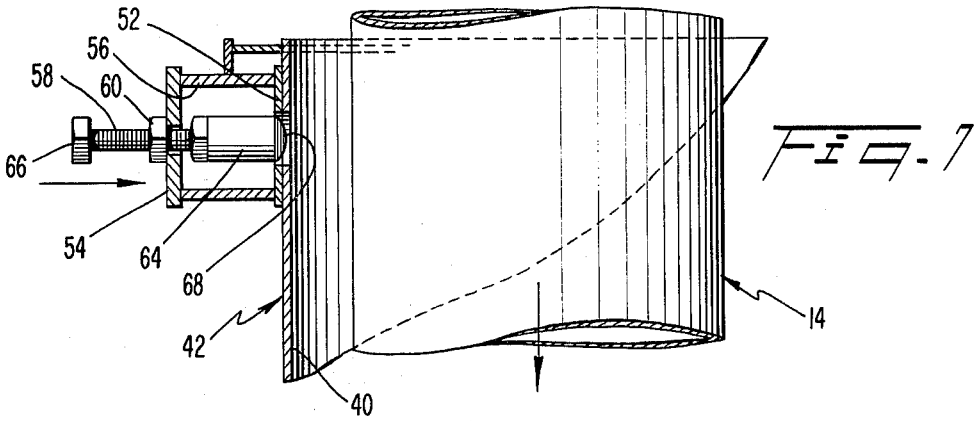
Fig. 7
Fig. 8
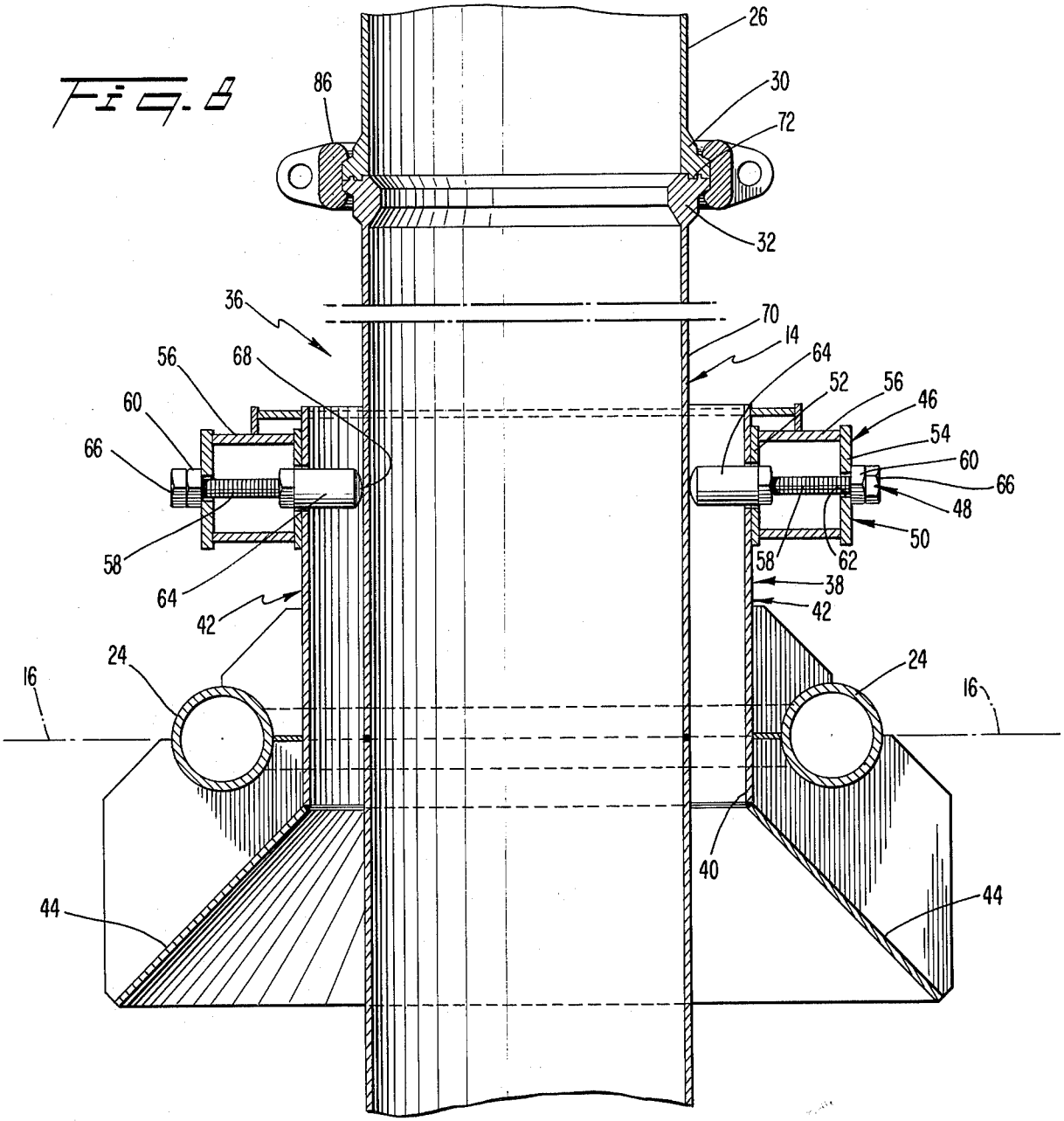

DOCKING AN OFFSHORE STRUCTURE WITH A SUBMERGED FIXTURE

BACKGROUND AND OBJECTS OF THE INVENTION

This invention relates to the docking of an offshore structure with a submerged fixture and, more particularly, to the docking of a jacket with a submerged wellhead in establishing an offshore facility for the recovery of crude oil or gas.

The production of crude oil or gas from submerged formations is being carried out on an ever increasing scale. Various techniques for underwater recovery of crude products are disclosed for example in the following U.S. Pat. No. 3,572,044 issued to Pogonowski on Mar. 23, 1971; No. 3,618,661 issued to Peterman on Nov. 9, 1971; No. 3,628,604 issued to Childers et al on Dec. 21, 1971; No. 3,717,002 issued to O'Brien et al on Feb. 20, 1973; No. 3,744,561 issued to Shatto, Jr. et al issued on July 10, 1973; No. 3,913,669 issued to Brun et al on Oct. 21, 1975; and No. 3,943,725 issued to Pennock on Mar. 16, 1976. Offshore activities of this sort typically involve the installation of production tubing into the formation and connecting a wellhead fixture to the tubing at the sea floor. A riser is secured to the wellhead to conduct crude product from the formation to a drilling platform supported above the wellhead. Oftentimes, the platform is installed after installation of the wellhead by lowering a support jacket onto the water bed around the wellhead and mounting a platform thereon above the water surface. The riser is then connected between the wellhead and the platform.

Installation of the jacket around the wellhead poses certain technical problems since it is usually desirable to locate the wellhead in a particular alignment relative to the jacket to optimize the performance of subsequent activities, such as connection of the riser to the wellhead. As to the latter, it should be noted that in some instances the riser is pre-installed on the jacket by temporary welds before the jacket is transported to the worksite. Once the jacket has been upended and immersed around the wellhead, the temporary welds are broken and the riser is allowed to descend onto the wellhead. Therefore, a relatively high degree of alignment is desirable to carry out this procedure.

In the aforementioned Pogonowski patent, a jacket is provided with one or more annular guide collars. By passing these collars downwardly around the wellhead as the jacket is lowered, at least a general alignment of sorts will likely be established. However, in order to make docking of the jacket with the wellhead possible, the guide collars must be formed somewhat larger than the wellhead. This gives rise to the possibility that precision alignment will not be established between the wellhead and jacket. Moreover, in the event that the guide collar is not perfectly centered relative to the wellhead once the jacket begins to sink into the water bed, it is possible for the jacket to impose sideward forces on the wellhead tending to dislodge it from its anchoring.

It is, therefore, an object of the present invention to minimize or obviate problems of the sort discussed above.

It is another object of the invention to provide novel methods and apparatus for aligning an offshore structure relative to a submerged fixture.

It is a further object of the invention to provide novel methods and apparatus for aligning a jacket with a wellhead.

It is an additional object of the invention to provide novel methods and apparatus for aligning a conduit carried by a jacket with a wellhead to facilitate hookup of the conduit to the wellhead.

It is still another object of the present invention to enable a jacket to be aligned with a wellhead in a manner requiring no estimating or guesswork on the part of an operator.

It is one more object of the invention to provide novel means for docking a jacket with a wellhead while imposing minimum lateral stresses on the wellhead.

It is a further object of the invention to provide novel methods and apparatus for aligning a jacket with a wellhead involving a plurality of displaceable pins carried by the jacket and which are engageable with the wellhead to establish predetermined alignment of the jacket with the wellhead.

BRIEF SUMMARY OF INVENTION

These objects are achieved in accordance with the present invention which involves the docking of an offshore structure such as a jacket with a submerged fixture such as a wellhead. The offshore structure is positioned in the water above the fixture and is lowered downwardly therearound. Prior to entry of the structure into the seabed, alignment means is interposed in contacting relation between the structure and fixture to locate the offshore structure in a predetermined position relative to the fixture. With the alignment means maintained in the interposed position, the offshore structure is lowered and becomes embedded in the seabed.

Preferably, the alignment means comprises a plurality of displaceable pins which are disposed on a guide collar of the offshore structure through which the wellhead passes. When the pins are fully advanced, they center the wellhead relative to a conduit carried by the offshore structure to enable the conduit to be lowered onto the wellhead.

THE DRAWING

Other objects and advantages of the present invention will become apparent from the following detailed description in conjunction with the accompanying drawings in which like numerals designate like parts and in which:

FIG. 7 is a fragmentary view of the alignment mechanism depicting an alignment pin prior to being advanced into engagement with the wellhead which extends through the guide collar;

FIG. 8 is a longitudinal sectional view of the wellhead and guide collar, taken along line 8—8 of FIG. 6 showing the jacket after having become embedded within the seabed and in alignment with the wellhead; and FIG. 9 is a view of the top of the wellhead carrying a bullplug.

DETAILED DESCRIPTION OF PREFERRED EMBODIMENT

In accordance with a preferred embodiment of the present invention, a submerged well installation 10 is established in a customary manner, such as from a floating barge, by installing production tubing 12 into the submerged formation of crude, and deploying a wellhead 14 at the upper submerged end of the production tubing 12. The wellhead thus constitutes a rigid fixture projecting a short distance above the seabed 16. Until recovery operations at the wellhead are initiated, the wellhead is closed-off and can be covered with a suitable corrosion preventing cap (not shown).

Figure 1:
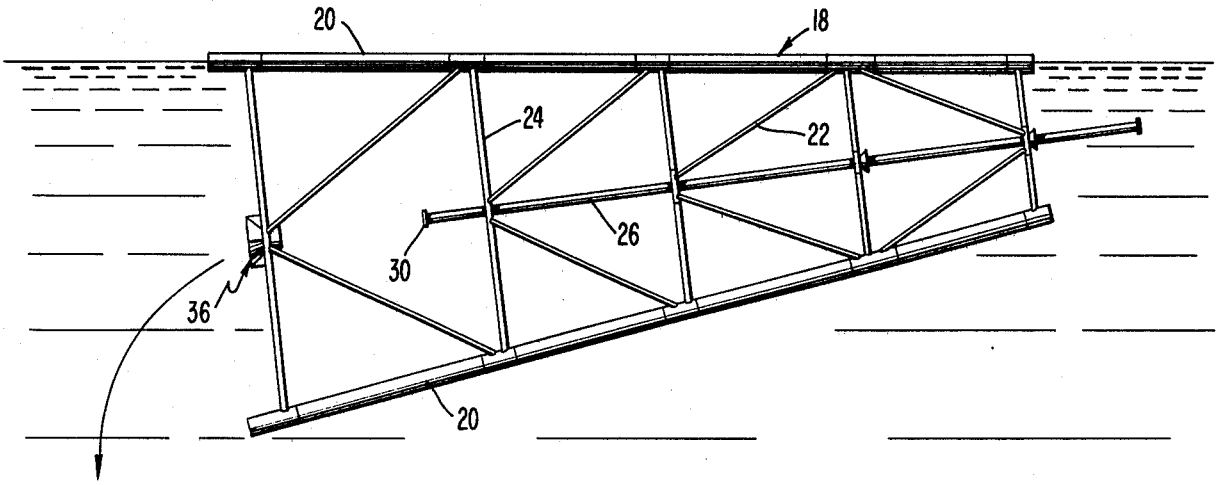
FIG. 1 is a side elevational view of a jacket, subsequent to being launched above a submerged wellhead.
Figure 2:
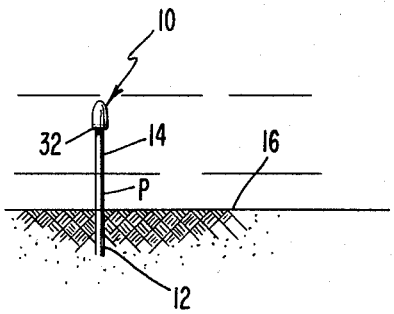
FIG. 2 is a view similar to FIG. 1 after the jacket has been uprighted and lowered toward the wellhead.
Figure 2:
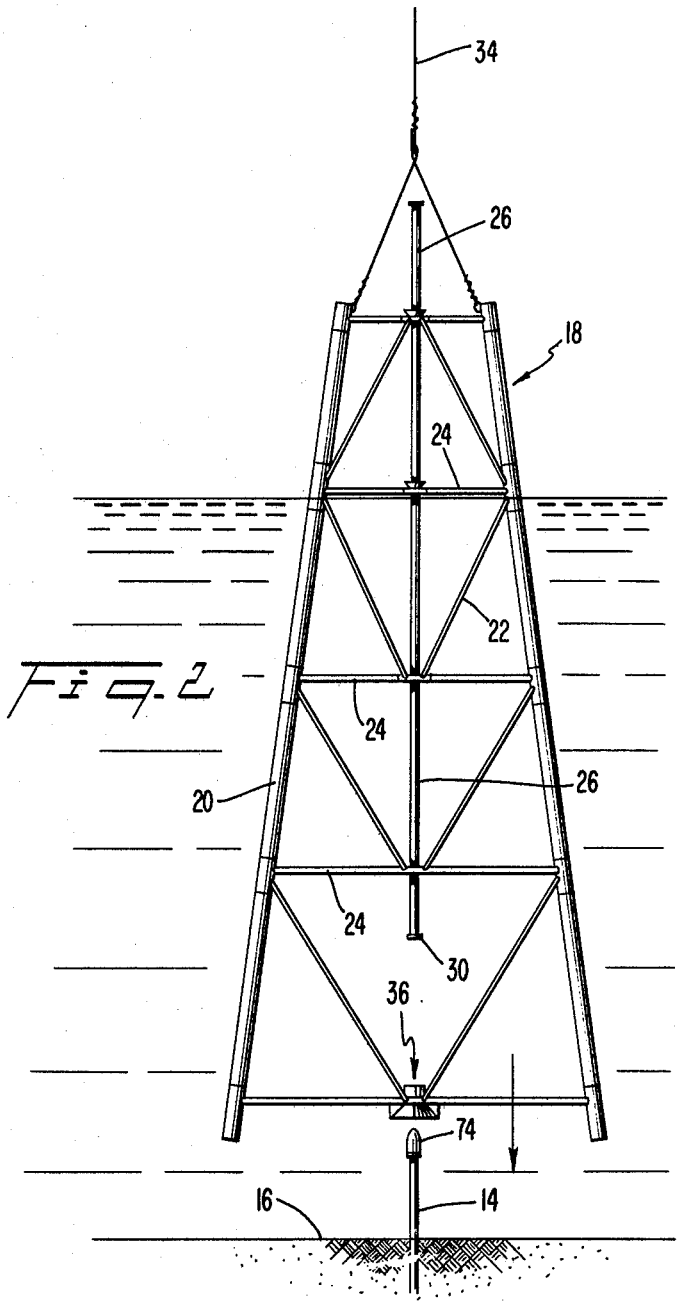

Recovery operations are preferably to be conducted from a stationary tower structure supported on the seabed. The installation of such a tower involves floating a jacket 18 to the worksite and submerging it onto the seabed around the wellhead 14. In one conventional technique, the jacket is floated on its side upon a barge, launched on its side into the water (FIG. 1), and then uprighted for descent (FIG. 2).

The jacket 18 preferably comprises a plurality of support columns or legs 20 which are connected together by a suitable open-truss brace arrangement which includes diagonal and horizontal bracing 22, 24.

Pre-installed on the jacket 20 is a recovery conduit or riser 26. This riser extends longitudinally of the jacket 18 in a substantially centrally located position between the columns 20. The riser 26 extends through openings in the horizontal braces and is affixed thereto by temporary welds. The riser preferably includes a radial flange 30 at its lower end to eventually mate with a radial flange 32 on the wellhead 14.

The jacket is adapted to be supported on an inclined ramp on a barge (not shown) and is launched therefrom by releasing connections therewith so that the jacket slides along the ramp and into the water. The jacket is then upended in any suitable manner, such as by appropriate ballasting and deballasting of buoyancy equipment on the columns such as taught, for example, in U.S. Koehler Pat. No. 3,693,361, issued on Sept. 26, 1972, and assigned to the assigneee of this invention. Subsequent descent of the jacket can be controlled by the buoyancy equipment and/or by a lift cable 34 which is actuated from an adjacent derrick barge (not shown). In this fashion, the jacket 18 can be suspended in the water in a position generally overlying the wellhead 14 and then gradually lowered.

Disposed at a bottom section of the jacket 18 below the lower end of the riser 26 is a guide assembly 36 (best shown in FIGS. 1 and 6 through 8). The guide assembly includes a guide collar 38 which defines a guide opening 40 aligned with the riser 26. The collar 38 is preferably affixed to a horizontal bracing 24. The collar includes a generally cylindrical portion 42 and an inverted cone-shaped portion 44 integrally connected at the lower end thereof. The cone-shaped portion 44 is flared downwardly and outwardly from the cylindrical opening 40 to facilitate docking of the jacket with the wellhead, as will be subsequently discussed.

Mounted on the outer periphery of the cylindrical portion 42 is an alignment mechanism 46. The alignment mechanism 46 comprises a plurality of circumferentially spaced, individually actuable alignment pins 48 which are respectively mounted in pin housings 50. Each pin housing comprises a base plate 52 fastened to the cylindrical portion 42, and an end plate 54 in radially, outwardly spaced relation thereto. Each alignment pin 48 is adjustably mounted within its associated pin housing 50. For example, the alignment pin 48 can include a threaded shank or actuating portion 58 which is threadedly mounted in a threaded nut 60 affixed to the housing 50 in alignment with an opening 612 in the end plate.

The pin also includes an alignment finger 64 which is able to pass through aligned openings in the base plate 52 and the cylindrical portion 42 of the collar 38 to project into the guide opening 40. The threaded actuating portion includes a stop element such as a polygonal head 66 at its outer end which is adapted to be gripped by a suitable tool for advancing or retracting the alignment pin 48.

Each alignment pin 48 is of a predetermined length from the tip 68 of the finger 64 to the head 66. This length is determined in accordance with the outer diameter of the wellhead 14. That is, when each of the pins has been fully inwardly advanced so that the heads 66 thereof abut against the stop nut 60 on the end plate 54, the wellhead 14 will be essentially contacted by all of the alignment fingers 64 and will be centrally located within the guide opening 40. When such a condition occurs, the wellhead and the riser will also be co-axially aligned.

Figure 4:
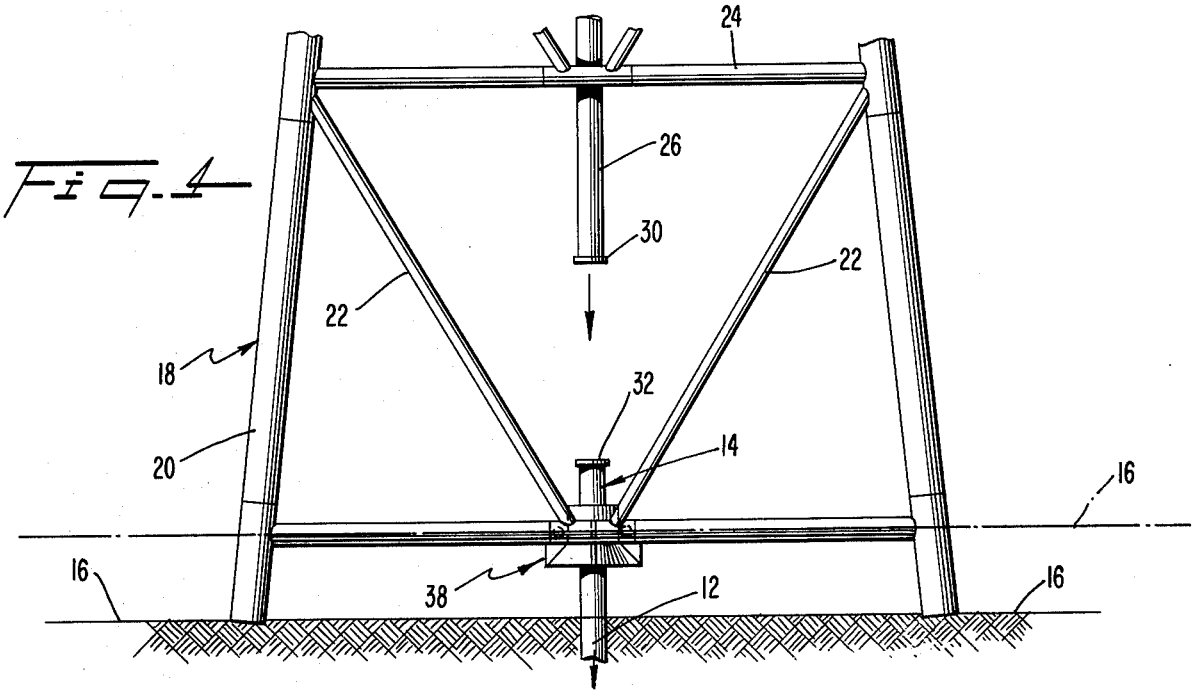
FIG. 4 is an enlarged view of the relationship between the guide collar and the wellhead depicted in FIG. 3.

The wellhead is shown in simplistic form in FIGS. 4 and 8 as including the radial flange 32 and a cylindrical contact surface portion 70 disposed therebelow. The wellhead flange 32 defines a seating ledge 72 which is operable to removably support a bull plug 74 (FIG. 9). The bull plug 74 conventionally comprises a hollow metallic member with a smoothly curved upper surface 76 which facilitates merging of the cone 44 and the wellhead 14. An eyelet 78 is located at the top of the bull plug 74 to enable the bull plug to be recovered by a cable or the like.

Figure 5:
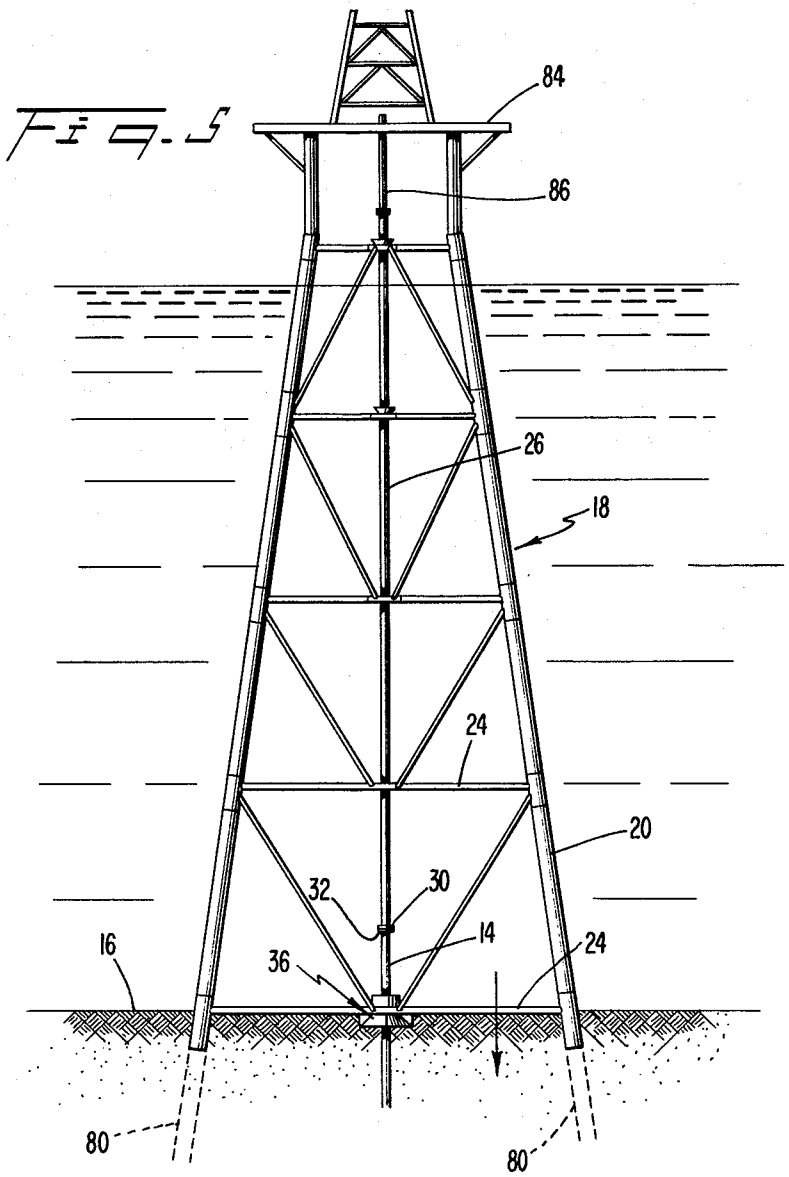
FIG. 5 is a view similar to FIG. 3 after the jacket and wellhead have been aligned and the jacket has been lowered so as to become embedded in the seabed.
Figure 3:
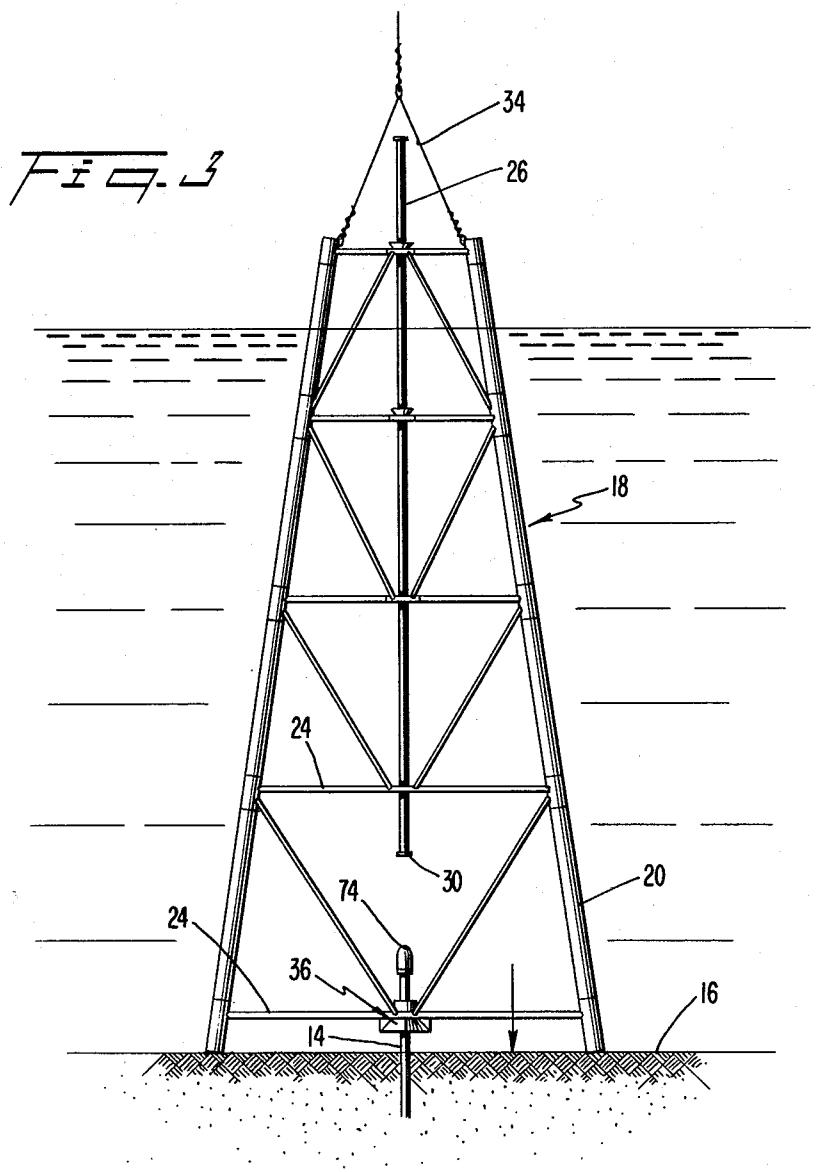
Figure 6:
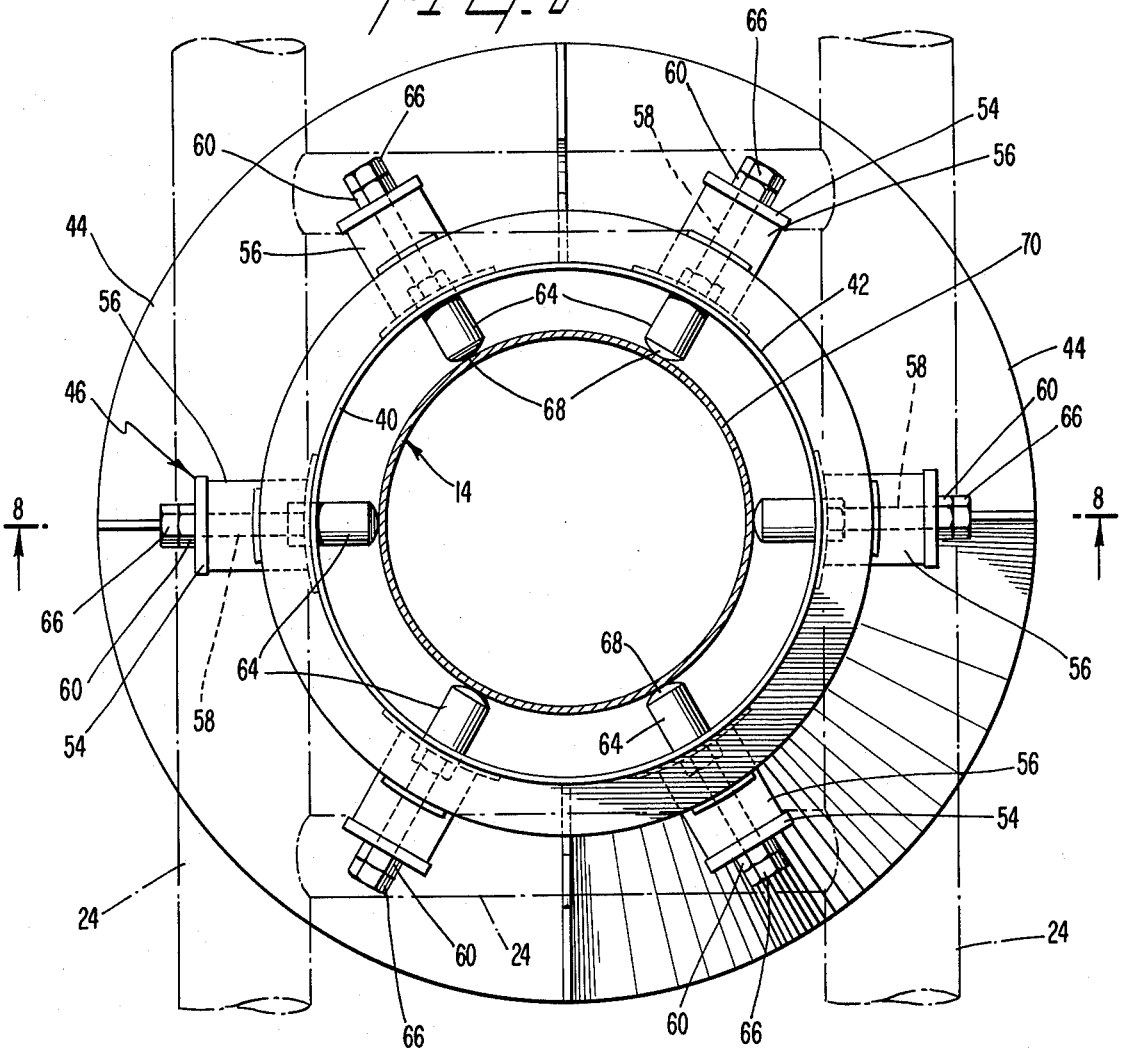
FIG. 6 is a horizontal, cross-sectional view, taken through the wellhead at a point just above the guide collar, after the guide collar has passed downwardly around the wellhead, and depicting in plan an alignment mechanism.

With the bull plug 74 resting upon the seating ledge 72, the suspended jacket 18 can be lowered until the inverted cone portion 44 of the guide collar 38 passes downwardly over the bull plug and the wellhead 14 enters the guide opening 40. At this point, descent of the jacket is halted before the legs 20 of the jacket 18 become embedded in the seabed to such a point that the jacket cannot be shifted laterally. It is permissible for the legs to enter the mudline as long as such lateral shifting is possible. A diver, who may have ridden down with the jacket, secures a cable to the eyelet 78 of the bull plug, and the latter is hauled to the surface. Before or after recovery of the bull plug, the diver advances the alignment pins 48 so that the alignment fingers 64 engage the contact surface 70 of the wellhead 14 beneath the wellhead flange 72. When all of the pins 48 have been fully advanced, so that the heads 66 have engaged the stop nuts 60, a properly centered relationship between the wellhead 14 and the guide opening 40, and thus between the riser 26 and the wellhead 14, is assured. The jacket 18 can then be allowed to descent further so that the legs 20 thereof enter and become embedded in the seabed 16 (FIG. 5). During this step, the jacket 18 remains properly positioned relative to the wellhead 14 by engagement of the alignment pins 48 with the contact surface portion 70 of the wellhead.

Pilings 80 may then be lowered through the legs 20 and suitably forced into the seabed to anchor the jacket, in conventional fashion.

When the jacket has been anchored, the temporary welds securing the riser are broken, allowing the riser 26 to descend onto the wellhead 14. Since precision alignment between the wellhead 14 and the riser 26 has been previously established by the alignment pins 48, the flanges 30, 32 on the riser are properly mated with the wellhead (FIG. 8). These flanges 30, 32 can then be secured together by a conventional fastener, such as a C-clamp 82, for example, to effectively couple the wellhead and riser together in fluid flow conducting relationship.

A platform 84 thereafter constructed atop the jacket in conventional fashion, and suitable tubing 86 is connected to the riser 26 to complete the connection to the wellhead 14.

OPERATION

Figure 3:
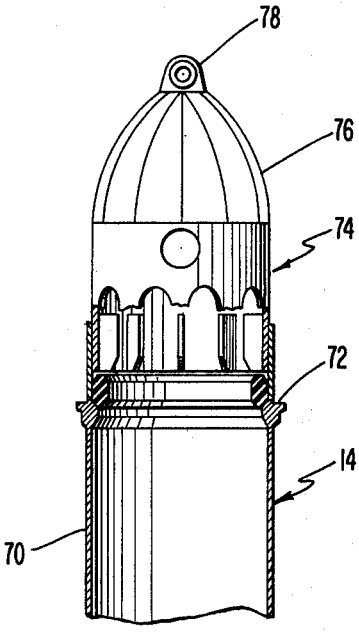
FIG. 3 is a view similar to FIG. 2 after the jacket has been lowered still further so that a guide collar on the jacket passes downwardly around the wellhead.

With the production tubing 12 and wellhead 14 installed in the seabed, the jacket 18 is floated to the worksite, launched, and uprighted in the water above the wellhead by conventional techniques. The jacket is then allowed to descent toward the wellhead 14 (FIG. 2). Underwater divers may aid in directing the descent of the jacket 18 so that the guide collar 38 passes downwardly around the bull plug 76 and the wellhead 14. Descent of the jacket 18 is then temporarily halted (FIG. 3). Divers secure a cable to the bull plug 76 and the bull plug is hauled to the surface. Before or after recovery of the bull plug, the diver fully advances the alignment pins 48 so that the pins engage the contact surface 70 of the wellhead 14 below the flange 32 thereof. When all of the pins 48 have been fully advanced, it is assured that the wellhead 14 and the riser 26 are aligned. Thereafter, with the pins 48 maintained in their advanced position, the jacket is allowed to descend further so that the legs 20 thereof become embedded and anchored in the seabed 20 (FIG. 4).

The temporary welds securing the riser 26 are then broken, and the riser is allowed to descend upon the wellhead 14 so that the flanges 30, 32 are disposed in mating relationship. These flanges 30, 32 of the wellhead and riser are then clampled firmly together.

A work platform 84 is installed atop the jacket 18 above the water surface and tubing is connected to the top of the riser 26 so that recovery operations can be instituted.

It is noted that underwater activities can be monitored from the surface by suitable cameras mounted on the jacket.

BRIEF SUMMARY OF MAJOR ADVANTAGES AND SCOPE OF THE INVENTION

The present invention greatly facilitates docking of a jacket with a submerged well installation. Precision alignment between the jacket and the wellhead is established by simply fully advancing a series of guide pins, in a manner which eliminates guesswork on the part of the operator. Since the jacket enters the water bed only after the jacket and wellhead have been aligned, no harmful sideward stresses on the wellhead are likely to occur. The precision alignment between the jacket and well head provided by this invention is of special benefit in those instances where a riser is pre-installed on a jacket, since proper mating is produced simply by gravitational descent of the riser, absent the need for any substantial underwater maneuvering by operations.

Although the invention has been described in connection with a preferred embodiment thereof, it will be appreciated by those skilled in the art that additions, modifications, substitutions and deletions not specifically described may be made without departing from the spirit and scope of the invention as defined in the appended claims. For instance, the alignment may be of various configurations and can be mounted in any suitable manner on the guide collar. These pins might also be arranged for advancement by a remote control mechanism to avoid diver actuation.

What is claimed is:

1. A method of docking an offshore structure with a submerged fixture, said structure having first leg means for engaging the seabed and second means spaced from the leg means for engaging said submerged fixture, comprising the steps of:

positioning said structure in the water above said fixture;

lowering said structure downwardly around said fixture so that said second means engages said fixture and has limited movement in a lateral direction, interposing alignment means in contacting relation between said second means and said fixture to locate said second means in a predetermined lateral position relative to said fixture; and with said alignment means maintained in said interposed position for maintaining alignment between said second means and said fixture, lowering said structure relative to said fixture until said first means becomes embedded in the seabed.

2. A method of docking a jacket with a submerged wellhead fixed in a bed of a body of water, said jacket having first leg means for engaging said water bed, comprising the steps of:

positioning said jacket in the water generally over said wellhead;

lowering said jacket relative to said wellhead so that a guide collar, located by said jacket and spaced from said leg means, passes downwardly around said wellhead and has limited movement in a lateral direction;

displacing alignment elements on one of said collar and said wellhead into engagement with the other of said collar and said wellhead to locate said wellhead in alignment with a conduit mounted thereabove on said jacket, said conduit being spaced apart from and out of contact with said alignment elements and said collar;

with said alignment means maintained in said engagement position, lowering said jacket relative to said wellhead to embed said first means in the water bed; and connecting said conduit and said wellhead together.

3. A method according to claim 2 wherein said displacing step comprises radially inwardly adjusting a plurality of threaded pins disposed on said guide collar to contact said pins with said wellhead to center said wellhead relative to said collar.

4. A method according to claim 3 wherein said inward adjustment is performed until stop portions of said pins engage stationary parts of said collar to automatically locate inner ends of said pins in centering positions.

5. A method according to claim 2 wherein said alignment means are interposed at a location below a radical flange on said wellhead, said jacket being lowered until a radial flange at the bottom end thereof engages said wellhead flange, and said connecting step comprises securing said flanges together.

6. A method according to claim 2 including the steps of disposing a bull plug atop said wellhead to facilitate passage of said guide collar over said wellhead, and removing said bull plug prior to said jacket lowering step.

7. A method according to claim 2 further including the steps of mounting a work platform on said jacket above the water surface, and connecting the upper end of said conduit with said work platform.

8. A method according to claim 2 wheren said connecting step comprises releasing said conduit and lowering said conduit onto said wellhead.

9. A method of docking a jacket with a submerged wellhead fixed in a body of water, comprising the steps of:

positioning said jacket in the water generally over said wellhead;

lowering said jacket relative to said wellhead so that an inverted cone-shaped guide collar on said jacket passes downwardly around said wellhead;

displacing a plurality of alignment pins, movably mounted on said jacket, into engagement with said wellhead at a point disposed below a first radial flange thereof, to align said wellhead with a riser carried by said jacket above and in alignment with said collar;

with said alignment pins engaging said wellhead, lowering said jacket relative to said wellhead to embed said jacket in the water bed;

releasing said conduit from connection with said jacket;

lowering said conduit until a second radial flange thereon engages said first flange;

coupling said flanges together to connect said conduit and said wellhead in flow conducting relationship; and mounting a work platform atop said jacket above the water surface.

10. A structure for being docked with a submerged fixture, comprising:

a frame structure having at its lower extremities leg means for engaging the seabed;

guide means located by said frame structure and spaced from said leg means for receiving said fixture when said frame structure is lowered therearound;

alignment means positionable in contacting relation between said guide means and said fixture to locate said frame structure in a predetermined alignment direction fixed by said fixture, means for supporting said alignment means at a lower portion of said structure so that said alignment means attains said contacting relation with said fixture prior to a time when said engaging means becomes embedded into the seabed; and said guide means and said alignment means providing for subsequent lowering of said structure into said seabed, with said alignment means maintained in said contacting relation;

whereby said frame structure remains in said predetermined alignment direction as said engaging means becomes embedded into said seabed and a connecting element lowered along said alignment direction engages said fixture.

11. A jacket for being docked with a submerged wellhead, said jacket comprising:

a frame;

a conduit releasably connected to said frame for movement along a defined path;

a guide collar disposed below, out of contact with, and in alignment with said conduit and being sized to receive said wellhead as said jacket is lowered;

means for supporting said guide collar in a fixed position relative to the frame and at a lower portion thereof so that the guide collar receives the submerged wellhead at a time prior to embedding the frame into the seabed; and a plurality of alignment elements carried by said jacket and being movable into engagement with said wellhead to orient said wellhead and conduit in a predetermined position of alignment so that said conduit, upon release from said jacket, can be lowered along said path into engagement with said wellhead.

12. A jacket according to claim 11 wherein said guide elements each comprise a pin displaceably mounted on said guide collar around the periphery thereof.

13. A jacket according to claim 12 wherein said guide collar comprises an inverted cone-shaped portion and a cylindrical portion thereabove carrying said pins.

14. A jacket according to claim 13 including stop means for limiting advancement of said pins prior to their full threaded capacity so that when said pins are fully adjusted inwardly, said wellhead is aligned with said conduit.

15. A jacket according to claim 14 wherein said pins are threadably mounted in said cylindrical portion for manual actuation by an operator.

16. Apparatus according to claim 11 wherein said conduit is secured to said frame by temporary welds.

17. A jacket adapted to be docked with a submerged wellhead and adapted to support a platform above the water surface, comprising:

a frame including a plurality of legs;

a conduit connected to said frame by temporary welds;

a guide collar supported by said frame disposed below and in alignment with said conduit and being sized to receive said wellhead as said jacket is lowered, said guide collar having an inverted cone-shaped section for passing downwardly around said wellhead as said jacket is lowered;

a cylindrical section disposed above said collar, and disposed below and in alignment with said conduit, through which cylindrical section said wellhead passes as said jacket is lowered;

a plurality of threaded pins adjustably secured around the periphery of said cylindrical section for radial movement into engagement with said wellhead; and stop means for limiting inward movement of said pins so that when said pins are fully inwardly adjusted, said wellhead is aligned with said conduit, so that said conduit can be released from said jacket and lowered into engagement with said wellhead.

* * * * *